US011128092B2

(12) United States Patent
Yang et al.

(10) Patent No.: US 11,128,092 B2
(45) Date of Patent: Sep. 21, 2021

(54) ROBUST, MINIATURIZED ELECTRICAL CONNECTOR

(71) Applicants: Amphenol AssembleTech (Xiamen) Co., Ltd, Fujian (CN); Amphenol East Asia Ltd., Taoyuan (TW)

(72) Inventors: Wen Chu Yang, Xiamen (CN); Hui Tang, Xiamen (CN); Zhenxing Liu, Xiamen (CN); Lo-Wen Lu, Taoyuan (TW); Wen Te Hsu, Taoyuan (TW)

(73) Assignees: Amphenol AssembleTech (Xiamen) Co., Ltd, Fujian (CN); Amphenol East Asia Ltd., Taoyuan (TW)

( * ) Notice: Subject to any disclaimer, the term of this patent is extended or adjusted under 35 U.S.C. 154(b) by 19 days.

(21) Appl. No.: 16/299,622

(22) Filed: Mar. 12, 2019

(65) Prior Publication Data

US 2020/0076132 A1 Mar. 5, 2020

(30) Foreign Application Priority Data

Sep. 3, 2018 (CN) ..... 201811019966.4
Sep. 3, 2018 (CN) ..... 201821433065.5

(51) Int. Cl.
*H01R 13/627* (2006.01)
*H01R 13/658* (2011.01)
(Continued)

(52) U.S. Cl.
CPC ..... *H01R 13/6461* (2013.01); *H01R 12/515* (2013.01); *H01R 12/52* (2013.01);
(Continued)

(58) Field of Classification Search
CPC ..... H01R 13/658; H01R 13/6582; H01R 13/502; H01R 13/516; H01R 13/627;
(Continued)

(56) References Cited

U.S. PATENT DOCUMENTS 5,397,250 A * 3/1995 Briones ..... H01R 13/7195 439/607.01
5,466,171 A 11/1995 Bixler et al.
(Continued)

FOREIGN PATENT DOCUMENTS

CN 304240766 S 8/2017
CN 304245430 S 8/2017
(Continued)

OTHER PUBLICATIONS

U.S. Appl. No. 16/206,753, filed Nov. 30, 2018 Lu et al.
(Continued)

*Primary Examiner* — Renee S Luebke
*Assistant Examiner* — Milagros Jeancharles
(74) *Attorney, Agent, or Firm* — Wolf, Greenfield & Sacks, P.C.

(57) ABSTRACT

A connector assembly configured for compact, high speed electronic systems. The assembly includes a board connector and a cable connector that may be mated by moving the cable connector in a mating direction perpendicular to a printed circuit board to which the board connector is mounted. The cable and board connectors may latch when mated and may be unlatched and unmated by pulling on a tab at a top of the cable connector in a direction opposite the mating direction. As a result, little clearance is required around the board connector to access the latching components. Such a connector may enable an electronic device with high signal integrity because the connector can be mounted close to an electronic component that processes high speed signals, providing a short, and high integrity signal paths for high speed signals.

26 Claims, 9 Drawing Sheets

(51) Int. Cl.

| | |
|---|---|
| ***H01R 13/6461*** | (2011.01) |
| ***H01R 12/51*** | (2011.01) |
| ***H01R 12/73*** | (2011.01) |
| ***H01R 12/52*** | (2011.01) |
| ***H01R 12/70*** | (2011.01) |
| ***H01R 12/75*** | (2011.01) |
| ***H01R 12/57*** | (2011.01) |

(52) U.S. Cl.
CPC ..... *H01R 12/57* (2013.01); *H01R 12/7064* (2013.01); *H01R 12/73* (2013.01); *H01R 12/75* (2013.01); *H01R 13/6273* (2013.01)

(58) Field of Classification Search
CPC ..... H01R 12/71; H01R 13/6461; H01R 13/6273; H01R 13/62922; H01R 13/62938; H01R 13/629; H01R 12/515; H01R 12/52; H01R 12/57; H01R 12/7064; H01R 12/73; H01R 12/75
See application file for complete search history.

(56) References Cited

U.S. PATENT DOCUMENTS

| | | | | |
|---|---|---|---|---|
| 5,713,755 | A | 2/1998 | Koopman et al. | |
| 5,961,399 | A | 10/1999 | Koopman et al. | |
| 5,971,789 | A | 10/1999 | Sukegawa | |
| 6,203,359 | B1 * | 3/2001 | Lee | H01R 13/5812 439/405 |
| 6,364,718 | B1 | 4/2002 | Polgar et al. | |
| 6,416,354 | B1 * | 7/2002 | Lee | H01R 13/6335 439/459 |
| 6,558,186 | B1 | 5/2003 | LePottier et al. | |
| 6,705,885 | B1 * | 3/2004 | Lin | H01R 13/6335 439/160 |
| 6,749,458 | B1 * | 6/2004 | Kuo | H01R 12/774 439/484 |
| 6,863,549 | B2 | 3/2005 | Brunker et al. | |
| 6,969,268 | B2 | 11/2005 | Brunker et al. | |
| 7,094,092 | B2 * | 8/2006 | Yang | H01R 12/79 439/495 |
| 7,137,832 | B2 | 11/2006 | Mongold et al. | |
| 7,335,063 | B2 | 2/2008 | Cohen et al. | |
| 7,479,017 | B1 | 1/2009 | Koopman et al. | |
| 7,837,499 | B1 * | 11/2010 | Chen | H01R 12/712 439/541.5 |
| 8,075,324 | B2 * | 12/2011 | Yamaji | H01R 13/6295 439/188 |
| 8,226,441 | B2 | 7/2012 | Regnier et al. | |
| 8,465,302 | B2 | 6/2013 | Regnier et al. | |
| 8,597,055 | B2 | 12/2013 | Regnier et al. | |
| 8,727,803 | B2 | 5/2014 | Kurachi | |
| 8,727,809 | B2 | 5/2014 | Mongold et al. | |
| 8,870,600 | B2 | 10/2014 | Wu et al. | |
| 8,979,551 | B2 | 3/2015 | Mongold et al. | |
| 9,070,987 | B2 | 6/2015 | Knowlden et al. | |
| 9,130,313 | B2 | 9/2015 | Mongold et al. | |
| 9,660,361 | B2 | 5/2017 | Knowlden et al. | |
| 9,991,641 | B1 * | 6/2018 | Annis | H01R 13/6582 |
| 10,263,349 | B2 * | 4/2019 | Phillips | H01R 12/7029 |
| 10,381,779 | B2 * | 8/2019 | Zhou | H01R 13/631 |
| 2003/0148647 | A1 | 8/2003 | Hisamatsu et al. | |
| 2003/0222282 | A1 | 12/2003 | Fjelstad et al. | |
| 2004/0235324 | A1 * | 11/2004 | Kimura | H01R 23/6873 439/108 |
| 2004/0242050 | A1 * | 12/2004 | Ke | H01R 13/6335 439/483 |
| 2005/0277334 | A1 * | 12/2005 | Huang | H01R 23/6873 439/607.01 |
| 2010/0144177 | A1 | 6/2010 | Vicich et al. | |
| 2011/0280520 | A1 | 11/2011 | Shimotsu | |
| 2015/0303608 | A1 | 10/2015 | Zerebilov et al. | |
| 2019/0052019 | A1 * | 2/2019 | Huang | H01R 13/6476 |
| 2019/0173209 | A1 | 6/2019 | Lu et al. | |
| 2019/0173232 | A1 | 6/2019 | Lu et al. | |

FOREIGN PATENT DOCUMENTS

| | | | |
|---|---|---|---|
| CN | 206712089 | U | 12/2017 |
| CN | 304493773 | S | 6/2018 |
| CN | 207677189 | U | 7/2018 |
| EP | 1172673 | A2 | 1/2002 |
| EP | 0836246 | B1 | 7/2002 |
| JP | 2008-112700 | A | 5/2008 |
| JP | 4286279 | B2 | 6/2009 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| WO | WO 2018/039351 | A1 | 3/2018 |

OTHER PUBLICATIONS

U.S. Appl. No. 16/210,966, filed Dec. 5, 2018, Lu et al.
U.S. Appl. No. 16/299,542, filed Mar. 12, 2019, Yang et al.
U.S. Appl. No. 16/556,728, filed Aug. 30, 2019, Lu.
U.S. Appl. No. 16/556,778, filed Aug. 30, 2019, Lu.
U.S. Appl. No. 16/684,755, filed Nov. 15, 2019, Lu.
U.S. Appl. No. 16/721,594, filed Dec. 19, 2019, Lu.
[No Author Listed], Cabline-CA 0.4mm Pitch Horizontal Type. I-PEX by Dahchi Seiko. 2015. 3 pages.
[No Author Listed], Cabline-CA 0.5mm Pitch Horizontal Type. I-PEX by Dahchi Seiko. 2015. 3 pages.
[No Author Listed], Firefly Application Design Guide. Samtec. Jan. 2017. 12 pages.
[No Author Listed], NearStack High-Speed Connector System and Cable Jumper Assemblies. Preliminary Datasheet. Molex 2017. 2 pages.

* cited by examiner

ROBUST, MINIATURIZED ELECTRICAL CONNECTOR

CROSS REFERENCE TO RELATED APPLICATIONS

This application claims priority to and the benefit of Chinese Patent Application No. 201821433065.5, filed Sep. 3, 2018, and Chinese Patent Application No. 201811019966.4, filed Sep. 3, 2018. The entire contents of these applications are incorporated herein by reference in their entirety.

This application contains subject matter related to U.S. Provisional Application No. 62/805,812, filed Feb. 14, 2019, entitled "ROBUST, HIGH-FREQUENCY ELECTRICAL CONNECTOR," to U.S. Provisional Application No. 62/802,619, filed Feb. 7, 2019, entitled "ROBUST, COMPACT ELECTRICAL CONNECTOR," and to U.S. Provisional Application No. 62/783,336, filed Dec. 21, 2018, entitled "ROBUST, MINIATURIZED CARD EDGE CONNECTOR." The entire contents of these applications are incorporated herein by reference in their entirety.

FIELD OF THE INVENTION

This disclosure relates generally to electrical interconnection systems and more specifically to miniaturized electrical connectors able to carry high-frequency signals.

BACKGROUND

Electrical connectors are used in many electronic systems. In general, various electronic devices (e.g., smart phones, tablet computers, desktop computers, notebook computers, digital cameras, and the like) have been provided with assorted types of connectors whose primary purpose is to enable an electronic device to exchange data, commands, and/or other signals with one or more other electronic devices. Electrical connectors are basic components needed to make some electrical systems functional. Signal transmission to transfer information (e.g., data, commands, and/or other electrical signals) often pass through electrical connectors between electronic devices, between components of an electronic device, and between electrical systems that may include multiple electronic devices.

It is generally easier and more cost effective to manufacture an electrical system as separate electronic assemblies, such as printed circuit boards ("PCBs"), which may be communicatively joined together with electrical connectors. In some scenarios, the PCBs to be joined may each have connectors mounted on them. The connectors may be mated together directly to interconnect the PCBs.

In other scenarios, the PCBs may be connected indirectly via a cable. Electrical connectors may nonetheless be used to make such connections. For example, the cable may be terminated at one or both ends with a plug type of electrical connector ("plug connector" herein). A PCB may be equipped with a receptacle type of electrical connector ("receptacle connector" herein) into which the plug connector may be inserted to connect the cable to the PCB. A similar arrangement may be used at the other end of the cable, to connect the cable to another PCB, so that signals may pass between the PCBs via the cable.

To facilitate manufacture of different parts of electronic devices in different places by different companies, aspects of the receptacle connectors and the plug connectors may be standardized, either through a formal standard-setting process or through adoption of a particular design by multiple manufacturers that intend to provide intermatable products. An example of an interconnection standard is the SAS or Serial Attached SCSI (Small Computer System Interface) standard. Another example is the SFP or Small Form-Factor Pluggable standard, as well as its variations: SFP+, QSFP, QSFP+, etc. Different standards have been developed as electronic devices generally have gotten smaller, faster, and functionally more complex. The different standards allow for different combinations of speed and density within a connector assembly.

For electronic devices that require a high-density, high-speed connector, techniques may be used to reduce interference between conductive elements within the connectors, and to provide other desirable electrical properties. One such technique involves the use of shield members between or around adjacent signal conductive elements of a connector system. The shields may prevent signals carried on one conductive element from creating "crosstalk" on another conductive element. The shields may also have an impact on an impedance of the conductive elements, which may further contribute to desirable electrical properties of the connector system.

Another technique that may be used to control performance characteristics of a connector entails transmitting signals differentially. Differential signals result from signals carried on a pair of conducting paths, called a "differential pair." The voltage difference between the conductive paths represents the differential signal. In general, a differential pair is designed with preferential coupling between the conducting paths of the pair. For example, the two conducting paths of a differential pair may be arranged to run closer to each other than to other adjacent signal paths in the connector.

With transmission speeds in servers and switches having already reached 56 Gbps and 112 Gbps, the transmission of high-speed signals by conventional PCBs is subject to ever greater limitations. The transmission of signals of a chip of a conventional server from the interior to an external interface is achieved via traces within a printed circuit board. Printed circuit boards have high signal loss and high attenuation for high speed signals. Cabled connections have been used to convey signals with low loss from the periphery of a printed circuit board to the interior of the printed circuit board.

SUMMARY

According to some aspects of the present technology, a cable connector comprises a terminal module, a plastic body, a shielding casing, a cable, two sliders and a pull rod. The terminal module is disposed in the plastic body and connected to the cable. The shielding casing covers the plastic body, and two sides of the shielding casing are each provided with an elastic plate having an engagement slot, the elastic plate protruding outside the plastic body. One end of the slider is provided with an outwardly protruding projection, and the elastic plate is provided with a tab adapted to the projection. The two sliders are movably mounted at two sides of the plastic body, the positions of the sliders being limited to the interior of the shielding casing, and two ends of the pull rod are connected to the sliders respectively.

In some embodiments, an outside face of the projection may be inclined or arcuate. The elastic plate may comprise an opening, with a rear-end edge of the opening bent outward to form the tab, and an inside face of the tab and the outside face of the projection having the same shape.

In some embodiments, two side faces of the plastic body may each comprise a guide groove. The slider may be movably mounted in the guide groove. Two side edges of the slider may each comprise a lug, and a step for limiting the position of the lug may be provided at a side edge of the guide groove.

In some embodiments, a rear end of the slider is provided with an engagement part, with an accommodating hole for accessing the engagement part in a corresponding position in the elastic plate. The engagement part may comprise a mounting hole and two ends of the pull rod may be respectively fixed in the mounting holes. A pull tab may be connected in a fixed manner to the pull rod.

In some embodiments, the terminal module comprises a first terminal module and a second terminal module arranged in parallel one above the other. The first terminal module may comprise a first plastic fixing member molded around a first row of terminals. The second terminal module may comprise a second plastic fixing member molded around a second row of terminals. The first terminal row and the second terminal row may each comprise first ground terminals and first signal terminal pairs arranged alternately in sequence. The first signal terminal pair may be formed of two first signal terminals which are symmetric with respect to each other, and the first terminal row and the second terminal row may be arranged in a staggered manner with respect to each other so as to form two parallel rows.

The width of the first ground terminal may be greater than the width of the first signal terminal.

The distance between the first ground terminal and the first signal terminal may be greater than the distance between two signal terminals.

In some embodiments, the plastic body comprises an upper portion and a mating portion. Two sides of the bottom of the mating portion may each be provided with an insert-connection arm. The upper portion and the bottom of the insert-connection arms may each have protrusions. The top of the shielding casing may be bent inward to form a front wall, and two sides of the bottom of the shielding casing may each form portions of a rear wall portions. Holes for engaging with the protrusions are respectively provided in the front wall and the rear wall portions.

Two sides of the front wall and outer sides of the rear wall portions may respectively bend toward the elastic plates to form extension arms for limiting the position of the elastic plates.

In some embodiments, an inner module, inside the cable connector, may cover soldering points between the cable and the terminal module.

Also disclosed in the present invention is a connector assembly, comprising a cable connector and a board connector; the cable connector may be the cable connector described above. Two sides of the board connector are each provided with an engagement hook; the shielding casing is latched via the connection of the engagement slot with the engagement hook, and the pull rod is used to drive the sliders to move in a direction away from the board connector such that the projections push open the interference parts to achieve disengagement of the engagement hooks from the engagement slots.

In some embodiments, the board connector comprises a metal shell, an insulating body fixed inside the metal shell, and a terminal assembly mounted in the insulating body. The terminal assembly comprises a third terminal module, a lossy strip and a fourth terminal module, arranged parallel to each other in sequence from top to bottom and fixed together; a metal grounding plate may be integrally formed by injection molding at a front end of the lossy strip. The third terminal module comprises a third plastic fixing member molded around a third row of terminals; the fourth terminal module comprises a fourth plastic fixing member molded around a fourth row of terminals. The third row of terminals and the fourth row of terminals may each comprise second ground terminals and second signal terminal pairs arranged alternately in sequence; some or all of the second ground terminals may be connected to the electrically conductive plastic strip via lossy blocks, and the third row of terminals and the fourth row of terminals may be staggered with respect to each other.

In some embodiments, two side faces of the board connector may each comprise a slot for accommodating the projection.

In some embodiments, the plastic body may comprise two locating holes on a side close to the board connector; the two locating holes are arranged diagonally, and two locating posts for fitting the locating holes are fixed in corresponding positions inside the board connector.

In some embodiments, bosses may be provided at the outside of three corners of the plastic body on a side close to the board connector, and the board connector may be provided with three recesses for engaging with the bosses.

Also disclosed in the present invention is a method for using a connector assembly: Bosses on the plastic body of the cable connector may be aligned with recesses of the insulating body of the board connector, locating posts on the insulating body may be inserted into locating holes of the plastic body, and the engagement slots at two edges of the shielding casing of the cable connector are engaged with the engagement hooks at side edges of the board connector, to complete the assembly of the connector assembly.

To unlatch and unmate the connectors, a pull tab may be pulled, such that the pull rod drives the sliders to slide toward a side remote from the board connector. The projections of the sliders may experience interference with the tabs on the elastic plates and push the elastic plates outward, and the engagement hooks on the board connector disengage from the engagement slots in the elastic plates; the pulling of the pull tab is continued, and the cable connector is disengaged from the board connector.

Also disclosed is an electronic system, comprising a printed circuit board comprising a surface; a high speed electronic component mounted to the surface of the printed circuit board; a board connector mounted adjacent to the high speed electronic component, wherein the board connector comprises opposite sides and engagement hooks extending from the sides; a cable connector mated with the board connector. The cable connector comprises an insulative body; a shielding casing at least partially surrounding the insulative body and having elastic plates spring biased inwards towards the sides of the board connector. The elastic plates have openings configured to receive the engagement hooks when the cable connector is mated to the board connector. The cable connector may also comprise slidable members, slidably mounted between the insulative body and shielding casing such that the slidable members slide, in a direction perpendicular to the surface of the printed circuit board and opposite a mating direction, between a latched position and an unlatched position. The slidable members comprise inclined faces configured to interfere with the elastic plates when in the unlatched position so as to press the elastic plates outwards. The cable connector may also comprise a pull tab coupled to the slidable members and accessible from a top of the cable connector such that pulling on the pull tab in a direction opposite the mating direction unlatches and unmates the connectors.

In some embodiments, the electronic system may further comprise a heat sink mounted to the processor; and the mated cable connector and board connector have a height less than or equal to a height of the heat sink.

In some embodiments, the electronic system may further comprise an I/O connector; and a cable coupling the cable connector to the I/O connector.

In some embodiments, the shielding casing may have openings exposing portions of the slidable members; the cable connector further comprises a rod coupled to the portions of the slidable members exposed in the openings; and the pull tab is connected to the rod.

Also disclosed is a board connector, comprising: an insulative body comprising two opposing sides; and a metal shell at least partially surrounding the insulative body. The metal shell may comprise at least one engagement hook adjacent each of the two opposing sides In some embodiments, each of the two opposing sides comprises a slot configured to accommodate a projection from a mating connector.

In some embodiments, the slots of each of the two opposing sides may extend in a mating direction from tops of the opposing sides.

In some embodiments, the at least one engagement hook may comprise two engagement hooks; and the slots of each of the two opposing sides may be between two engagement hooks.

The foregoing features may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

KEY TO LABELS USED FOR PRINCIPAL COMPONENTS

Figure 1:
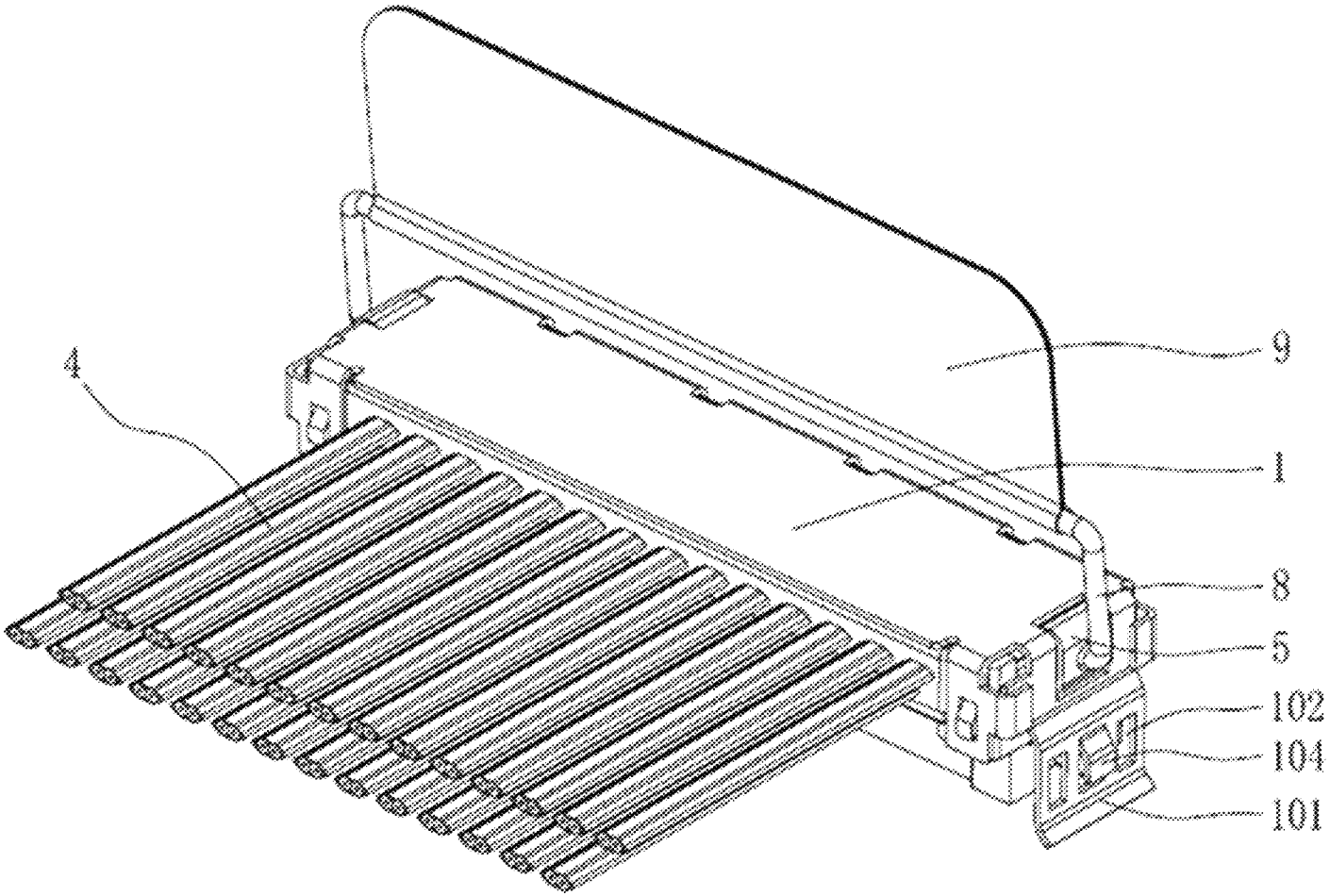
FIG. 1 is a perspective view of an exemplary embodiment of a cable connector.
Figure 2:
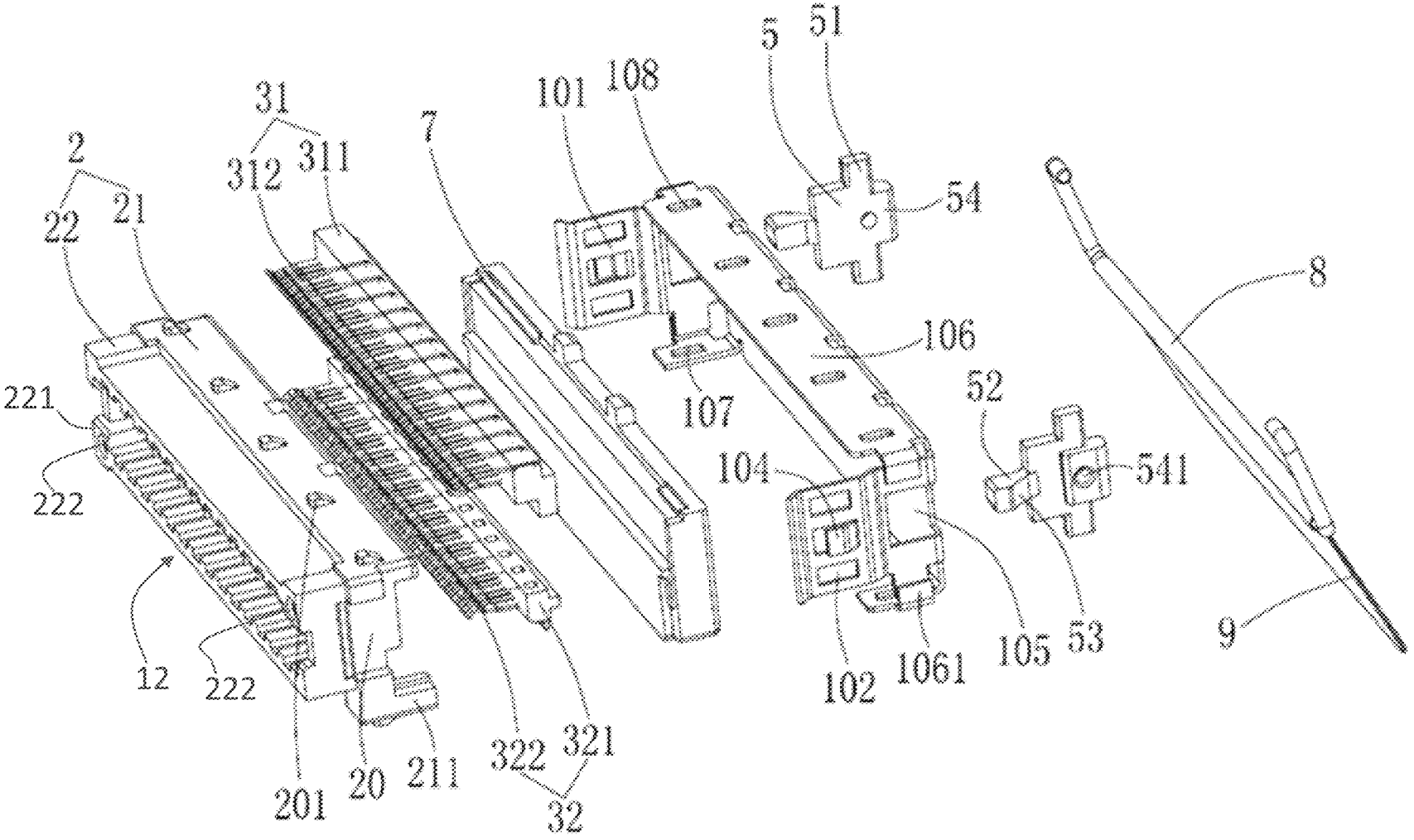
FIG. 2 is an exploded diagram of the components of the cable connector of FIG. 1.
Figure 3:
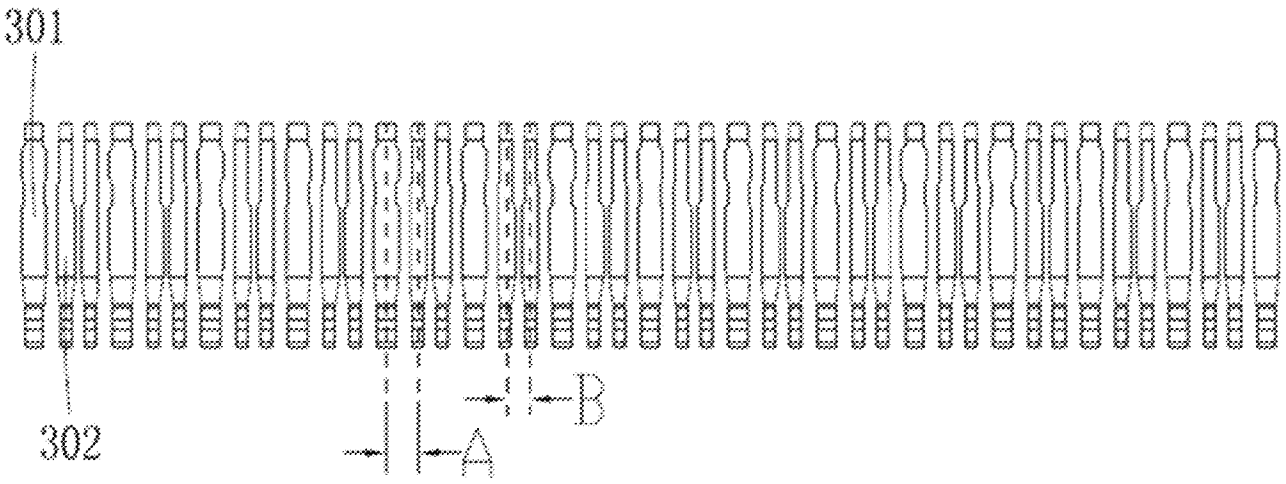
FIG. 3 is a side view of the terminal arrangement of a first terminal row or a second terminal row of the cable connector of FIG. 1.
Figure 4:
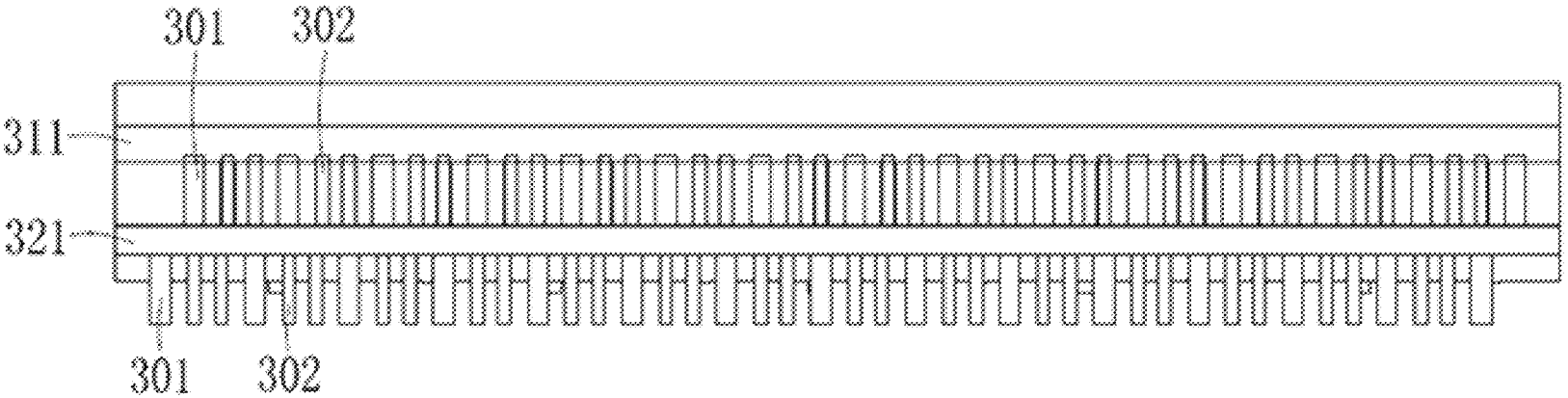
FIG. 4 is a top view of a terminal module of the cable connector of FIG. 1.
Figure 5:
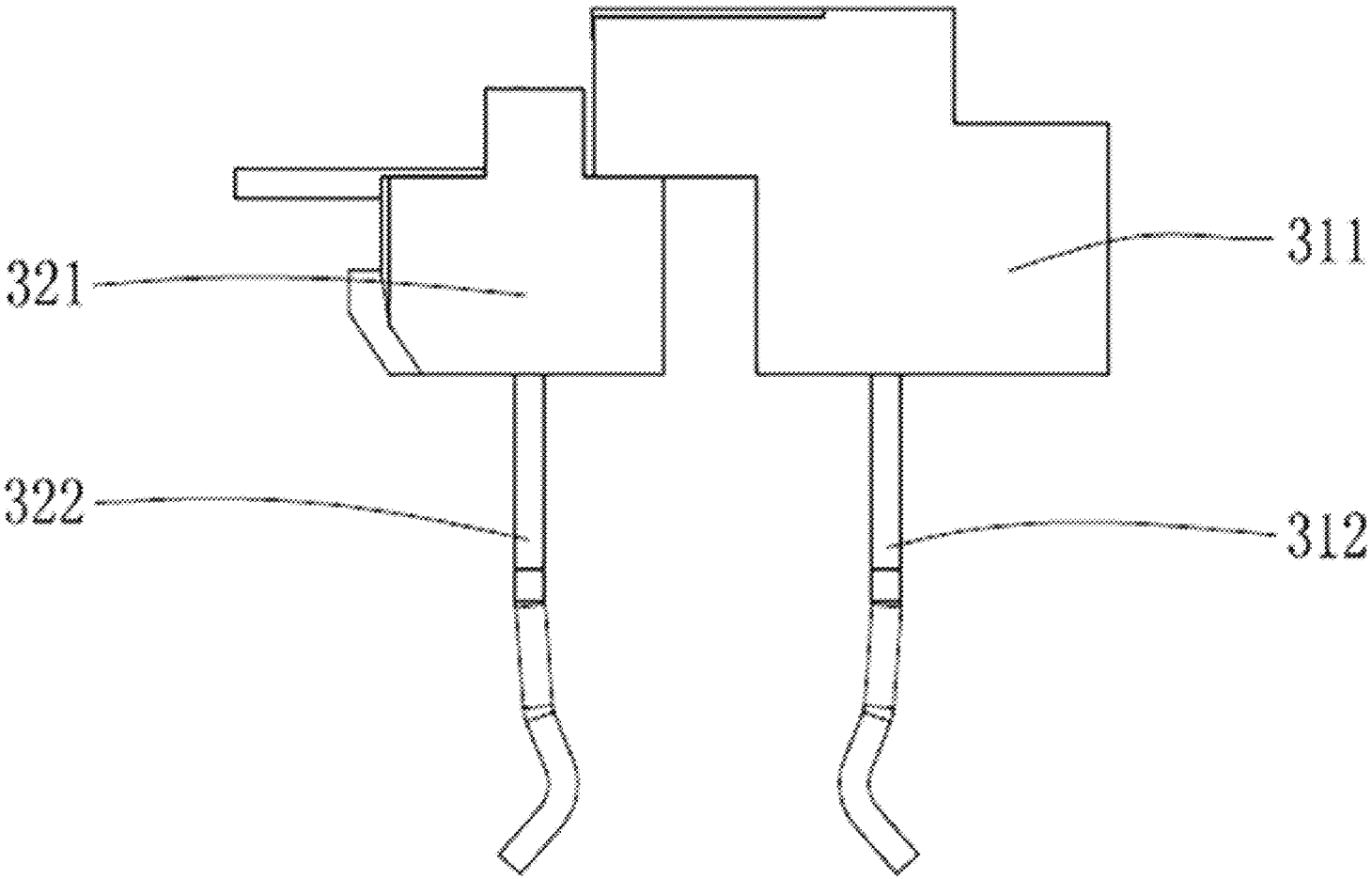
FIG. 5 is an end view of the terminal module of FIG. 4.
Figure 6:
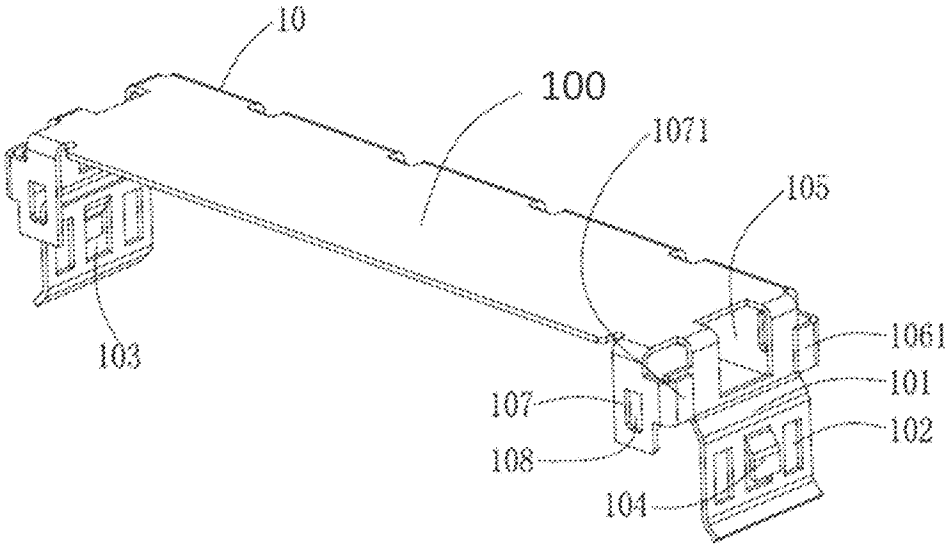
FIG. 6 is a perspective view of a shielding casing.
Figure 7:
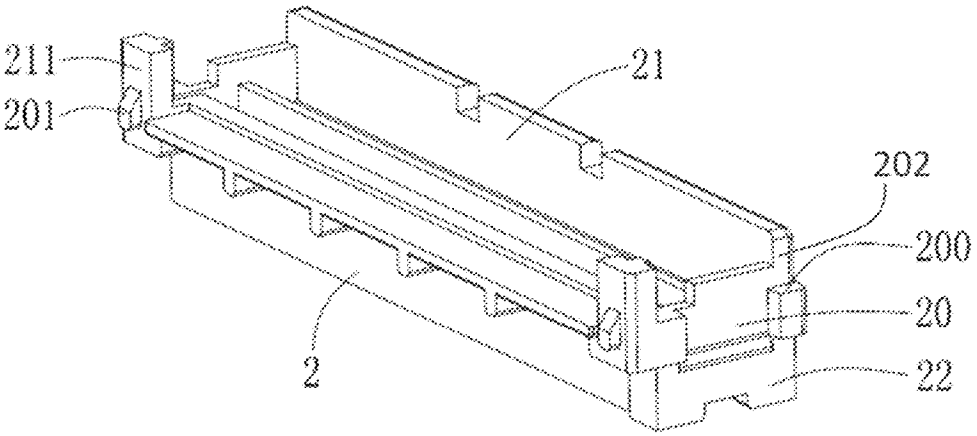
FIG. 7 is a perspective view of a plastic body of the cable connector of FIG. 1.

1—cable connector;
10—shielding casing;
100—top panel;
101—elastic plate;
102—engagement slot;
103—opening;
104—tab;
105—accommodating hole;
106—front wall;
1061—first extension arm;
107—rear wall portions;
1071—second extension arm;
108—limiting hole;
12—mating interface
13—mating direction
2—plastic body;
20—guide groove;
200—step;
201—protrusion;
202—space
21—upper portion;
211—insert-connection arm;
22—mating portion;
221—boss;
222—locating hole;
31—first terminal module;
301—first ground terminal;
302—first signal terminal;
311—first plastic fixing member;
312—first terminal row;
321—second plastic fixing member;
322—second terminal row;
4—cable;
5—slider;
51—lug;
52—projection;
53—inclined face;
54—engagement part;
541—mounting hole;
6—board connector;
60—slot;
601—engagement hook;
602—recess;
603—locating post;
6031—soldering part;
604—second ground terminal;
605—second signal terminal;
61—metal shell;
62—insulating body;
63—third terminal module;
631—third plastic fixing member;
632—third row of terminals;
64—lossy strip;
641—lossy block;
65—fourth terminal module;
651—fourth plastic fixing member;
652—fourth row of terminals;
66—metal grounding plate;
7—inner module;
8—pull rod;

9—pull tab;

A: distance between first ground terminal and first signal terminal;

B: distance between two first signal terminals connected to each other.

80—electronic system

81—I/O connector

82—printed circuit board

83—electronic component

84—connector assembly

85—cable

86—processor

87—heat sink

DETAILED DESCRIPTION

The inventors have recognized and appreciated that high-frequency and compact electronic systems are enabled by high-speed connectors that are of relatively low height that are suitable for us at the periphery of processors. Further, the inventors have recognized and appreciated designs for such connectors that enable the connectors to be mounted in a relatively small area of the printed circuit board with little separation from other areas of the printed circuit board in which other electronic components are mounted. Such an electronic system may be assembled in a compact way with a relatively low cost. Further, the inventors have recognized and appreciated connector designs that provide ease of operation, including enabling a connector assembly to be unlatched and removed with motion in a single direction.

Embodiments of a cable connector may have a terminal module, a plastic body, a shielding casing, a cable, two sliders and a pull member, such as a pull rod. The terminal module may be disposed in the plastic body and connected to the cable. The shielding casing may cover the plastic body, and two sides of the shielding casing may each be provided with an elastic plate having an engagement slot. The elastic plate may be outside the plastic body. One end of the slider may be have an outwardly protruding projection. The elastic plate may have a tab shaped to adapt to the projection, when the elastic plate is in a latched position. The two sliders may be movably mounted at two sides of the plastic body, and the mounting may limit the motion of the sliders such that they are retained in the interior of the shielding casing. Two ends of the pull rod may be connected to the sliders respectively so that the slider may be moved from the latched position to a position in which the projection pushes on the elastic plate to move it into an unlatched position.

Also disclosed herein are a connector assembly and a method for using the same. Connectors as described herein may have a small size, enabling mounting of a board connector adjacent a high speed component, such as a processor chip. In some embodiments, for example, the connector may be mounted in a region of the printed circuit board at the periphery of a processor chip, and may support low loss, high speed cabled connections to the processor chip, while providing simple latching and unlatching.

Connectors with designs as disclosed herein may be small. In contrast to a the height of a conventional connector, which is generally greater than 12 mm, a connector as described herein can be shorter, and may have, for example, a height of less than 9 mm. Such a connector can be placed in a region at the periphery of a processor chip. Accordingly, a connector as described herein may support an electronic device that operates with high speed signals because signals are routed to the processor with a very short path through a printed circuit board where signal integrity might degrade. Rather, the signals may be routed to and from the processor chip in cables that have high signal integrity. Thus, the electronic device has low signal loss, high transmission efficiency, and strong signal integrity. A latching design as described herein can be easily accessed and may be support unmating of the connector, as the same motion to unlatch may also unmate the connectors.

As shown in FIGS. 1-7, a cable connector 1 comprises a shielding casing 10, a plastic body 2, a first terminal module 31, a second terminal module 32, cables 4, sliders 5 and an inner module 7.

The plastic body 2 serves as a portion of the housing for connector 1. Plastic body 2 may be molded from an insulative material, such as a thermoplastic or nylon. Plastic body 2 may be integrally molded as a unitary member with features as described herein and may be shaped to engage with other components that form a housing, such as inner module 7. Though, in some embodiments, a housing may be assembled from more or fewer components that are held together in any suitable way.

In the embodiment illustrated, plastic body 2 has an upper portion 21 and a mating portion 22. Two sides of the top of the upper portion 21 may each be provided with an insert-connection arm 211, which may be shaped to receive a portion of inner module 7.

Mating portion 22 may be shaped for insertion into a mating connector. Bosses 221 may be provided at the outside of one or more corners of the mating portion 22. Here, bosses 221 are shown on three corners. Two locating holes 222 may be provided on a side of the mating portion 22 close to a board connector 6 and forming a mating interface 12. The two locating holes 222 may be arranged diagonally.

Shielding casing 10 may be made of a conductive material, such as metal. In the illustrated embodiment, shielding casing 10 may be formed from a sheet of metal that is cut and then bent into a shape. Shielding casing 10 may cover a large portion of the exterior of the housing for connector 1 that would otherwise be exposed when connector 1 is mated with a complementary connector, such as connector 6. That portion, for example, may be greater than 75%, greater than 85% or greater than 90%, for example. Shielding casing 10 may be connected to ground, such as by connections to the ground conductors within cable 4 or via connection to grounded components in a mating connector, such as connector 6. Shielding casing 10 may provide shielding against electromagnetic radiation. In the illustrated embodiment, shielding casing 10 also provides mechanical functions, including retaining a slidable member, such as slider 5, and forms a portion of the latching system for the connector.

The metal used to be form shielding casing 10 may be sufficiently thin that plates of that metal can deflect elastically. As an example, such plates may have a thickness on the order of 0.1 mm, such as between 0.16 and 0.2 mm in some embodiments, and may be cut free along three sides. Such plates may serve as a portion of the latching mechanism for connector 1. In the embodiment illustrated, two sides of the shielding casing each are configured as an elastic plate 101. Elastic plates 101 are bent inward such that they have a rest state in which they are biased towards or press against plastic body 2. However, due to their elastic nature, elastic plates 101 may deflect away from plastic body 2 during a mating or unmating operation. As shown, elastic plate 101 has an edge protruding forward relative to the plastic body 2. That edge is tapered such that, during insertion of connector 1 into a mating connector 6, elastic plate 101 may be urged outwards, away from plastic body 2 as a result of the tapered edge being pressed against a feature of a mating connector 6. Elastic plate 101 may then slide over features extending from the mating connector 6, as described in more detail, below.

A plurality of terminals are held within the housing of connector 1. Here, the terminals are held together as terminal modules, which in turn are held within plastic body 2. Each of the terminals has a mating contact portion, a contact tail and an intermediate portion joining the mating contact portion and the contact tail. In the illustrated example, the terminals are held by insulative members forming terminal modules. At one end of the first terminal module 31 and one end of the second terminal module 32, the contact tails are separately connected to conductors of the cables 4.

The first terminal module 31 comprises a first plastic fixing member 311 holding a first row of terminals 312. In the embodiment illustrated, the terminals may be secured to the fixing member 311 by injection molding fixing member 311 around an intermediate portion of the terminals. The second terminal module 32 may be formed in a similar way. In the embodiment illustrated, second terminal module 32 includes a second plastic fixing member 321 and a second row of terminals 322 which also may be formed by injection molding.

The first row of terminals 312 and the second row of terminals 322 may both include differently shaped terminals, with wider terminals being configured for connection to ground. Narrower terminals may be configured in pairs between adjacent ground terminals, which positions the narrower terminals in a configuration suitable for carrying differential signals. Accordingly, each row may be formed by arranging first ground terminals 301 and first signal terminal pairs alternately in sequence. The first signal terminal pair may be formed of two first signal terminals 302 disposed symmetrically with respect to each other.

In some embodiments, the first row and the second row may be configured differently. Each row may have the same repeating pattern of signal pairs and ground terminals. However, the patterns may be offset with respect to one another such that the mating contact portions of the pairs or signal terminals in opposing rows are offset from one another in a direction parallel to the row. In some embodiments, the positions of the first ground terminals 301 of the first row of terminals 312 may correspond to the positions of the first signal terminal pairs of the second row of terminals 322. The positions of the first signal terminal pairs of the first row of terminals 312 correspond to the positions of the first ground terminals 301 of the second row of terminals 322. The overall width of the first ground terminal 301 is greater than the overall width of the first signal terminal 302. The distance A between the first ground terminal 301 and the first signal terminal 302 is greater than the distance B between two first signal terminals 302.

Connector 1 may be assembled by inserting the first terminal module 31 and second terminal module 32 into plastic body 2 such that the mating contact portions of the terminals are exposed at a mating interface of the connector 1. In the illustrated embodiment, the mating contact portions are held in two parallel rows on opposite sides of a slot through plastic body 2. That slot is configured to receive an island of a mating connector with two exteriorly facing walls that carry mating contact portions of terminals of mating connector. The mating contact portions of the mating connector are configured such that they align with and come into contact with the mating contact portions of the terminals of connector 1 when the connectors are mated.

Once the first terminal module 31 and second terminal module 32 are inserted into plastic body 2, inner module 7 may be applied to cover the cable attachments, which may be the points at which the conductors of the cable 4 are soldered or otherwise attached to the contact tails of the terminals of first terminal module 31 and second terminal module 32 on the other. Inner module 7 may be formed as a separate piece that engages with plastic body 2, such as by molding inner module 7 of plastic. In such an embodiment, complementary features may be including on plastic body 2 and inner module 7 so that those components are positioned and engaged with respect to one another. Alternatively, inner module 7 may be formed by molding material in place within and/or around plastic body 2.

Shielding casing 10 may be designed to at least partially surround the insulative housing of connector 1. The sheet of metal forming shielding casing 10 may be bent inward to form a top panel 100 and a front wall 106. The sheet of metal forming shielding casing 10 may also be bent to form rear wall portions 107. Here, rear wall portions 107 form a partial wall, leaving space for cables 4 to pass through shielding casing 10. Rear wall portions 107 are connected to arms 211. Two sides of the front wall 106 are respectively bent toward the elastic plates 101 to form first extension arms 1061. Outer sides of the rear wall portions 107 are bent toward the elastic plates 101 to form second extension arms 1071. The extension arms may retrain movement of the upper portions of elastic plates 101. In some embodiments, the extension arms may be attached to elastic plates 101, such as by welding or insertion of tabs from the extension arms into openings in the elastic plates 101, or in any other suitable way.

The plastic body 2 and shielding casing 10 may be configured such that shielding casing 10 is held to plastic body 2. In the illustrated embodiment, plastic body 2 has an upper portion 21 with protrusions 201 for engaging shielding casing 10. The protrusions 201 make a secure fit within openings 108 in shielding casing 10, holding shielding casing 10 to plastic body 2. Similar protrusions, which engage similar openings 108, are also formed in other locations on the components that form the housing for connector 1 such that shielding casing 10 is held to the connector housing. Protrusions may be formed on the arms 211, for example.

Plastic body 2 also may be formed with features that enable latching and unlatching as described herein, including by enabling slider 5 to be slidably mounted between plastic body 2 and shielding casing 10. Guide grooves 20 may be formed in two side faces of the plastic body 2. Edges of guide groove 20 may be shaped with a limiting steps 200, which positioned to leave a space 202 between the upper edge of steps 200 and the upper edge of the side face.

Slider 5 may also be shaped to facilitate slidable mounting. A lug 51 may be formed on each of two side edges of slider 5. The slider 5 may be mounted in the guide groove 20 such that the lugs 51 fit within space 202. Lugs 51 may press against the limiting steps 200 when slider 5 is slid to its lowermost position, when the lug 51 is closest to mating interface 12.

A front end of the slider 5 may include a projection 52. The projection 52 may protrude outward relative to an outside face of the slider 5. A connection face of the projection 52 of the slider 5 may be tapered, providing an inclined face 53. In the illustrated embodiment, projection 52 has a width, in a lateral direction which is away from plastic body 2 and towards shielding casing 10 that increases along the length of projection 52 in a mating direction 13.

Inclined face 53 may be shaped and positioned to push elastic plate 101 away from plastic body 2 when slider 5 is pulled in a direction opposite the mating direction 13.

Elastic plate 101 may be shaped to engage with inclined face 53. The elastic plate 101 may have an opening 103 in a position corresponding to the projection 52. Opening 103 may be cut in elastic plate 101 to leave a tab 104, connected at one edge to elastic plate 101. In the embodiment illustrated, an inside face of the tab 104 and an outside face of the projection 52 have the same shape, such that, when projection 52 is centered within the opening 103, tab 104 will conform to projection 52 such that projection 52 does not press elastic plate 101 away from plastic body 2. Projection 52 may have this position, for example, when it is pressed towards the mating interface 12 such that lug 51 press against limiting steps 200. Because slider 5 is positioned to slide, it may be slid into other positions in which elastic plate 101 is pressed away from plastic body 2.

A top end of the slider 5 is provided with an engagement part 54 to which a pull member may be attached. Elastic plate 101 may have an accommodating hole 105 at the position of the engagement part 54 such that a pull member may be attached to the engagement part 54. In the illustrated embodiment, engagement part 54 has a mounting feature to which a pulling member may be attached. In the illustrated embodiment, that mounting features is a mounting hole 541 and the pulling member is a pull rod 8, with a cross section that fits within mounting hole 541. Two ends of a pull rod 8 respectively pass through the accommodating holes 105 and are inserted into the mounting holes 541. Mounting holes 541 may be slightly larger than the diameter of pull rod 8 such that pull rod 8 may rotate. Alternatively, pull rod 8 may fit snugly within mounting holes 541 such that it does not rotate. Accordingly, pull rod 8 may be held in or rotated into a position in which pull rod 8 extends in a direction opposite mating direction 13. Pull tab 9 may be fixed to a supporting bar of the pull rod 8 and may be pulled in a direction opposite mating direction 13 such that the slider 5 moves in a direction opposite the insertion direction 13 to lift elastic plate 101 away from plastic body 2, which may unlatch connector 1 from a mating connector 6 and may also pull connector 1 to unmate it.

Figure 8:
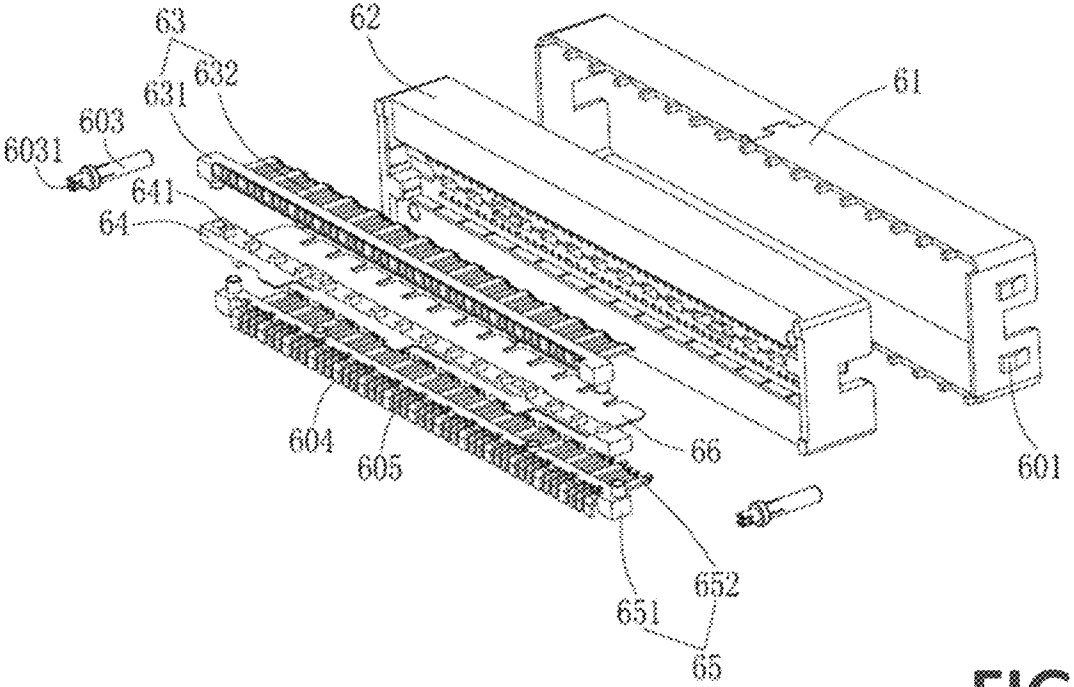
FIG. 8 is an exploded diagram of the components of a board connector configured to mate with the cable connector of FIG. 1.
Figure 9:
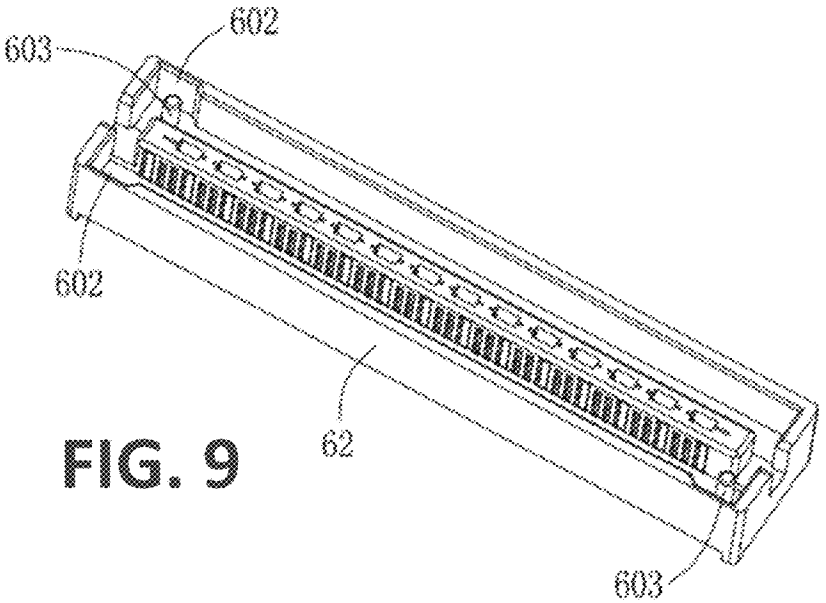
FIG. 9 is a perspective view of an insulating body of the board connector of FIG. 8.

As shown in FIGS. 8 and 9, the board connector 6 may have a metal shell 61, an insulating body 62 and two terminal assemblies, positioned to mate with terminal modules 31 and 32. The insulating body 62 may be fixed inside the metal shell 61. The material of the insulating body 62 may be plastic or another insulating material, and the terminal assembly may be fixed inside the insulating body 62. The terminal assembly may comprise a third terminal module 63, a lossy strip 64 and a fourth terminal module 65, arranged parallel to each other in sequence from top to bottom. Lossy strip 64 may be formed of electrically conductive plastic, such that a metal grounding plate 66 may be integrated into the lossy strip 64 by injection molding electrically conductive plastic around it at a front end of the lossy strip 64.

On a face abutting the cable connector 1, the board connector 6 may have three recesses 602 for engaging with the bosses 221. Two locating posts 603 may be positioned within the board connector 6 for inserting into the locating holes 222. The locating posts 603 may extend continuously to an end face at an end of the board connector 6 remote from the cable connector 1 and form soldering parts 6031. The soldering parts 6031 may be soldered to a printed circuit board to which connector 6 is mounted, to increase the product strength.

The terminal modules of connector 6 may be made using techniques similar to those used to make the terminal modules of connector 1. The third terminal module 63 comprises a third plastic fixing member 631 that is injection molded around a third row of terminals 632. The fourth terminal module 65 comprises a fourth plastic fixing member 651 that is insert molded around a fourth row of terminals 652. The third row of terminals 632 and the fourth row of terminals 652 may each have second ground terminals 604 and second signal terminal pairs alternately in sequence. The second signal terminal pair may be formed of two second signal terminals 605 disposed symmetrically with respect to each other.

All of the second ground terminals 604 may be connected to the lossy strip 64 via lossy blocks 641. The lossy blocks 641 may be integrally formed with the lossy strip 64. The positions of the second ground terminals 604 of the third row of terminals 632 correspond to the positions of the second signal terminal pairs of the fourth row of terminals 652. The positions of the second signal terminal pairs of the third row of terminals 632 correspond to the positions of the second ground terminals 604 of the fourth row of terminals 652.

Connector 6 may also be configured for latching with connector 1. Two side faces of the board connector 6 may each have one or more engagement hooks 601 configured to engage with elastic plate 101 when elastic plate 101 is not being held away from plastic body 2 by projection 52. In the embodiment illustrated, the engagement hooks 601 are formed as tabs cut from a sheet of metal forming the metal shell 61 of the board connector 6. In the embodiment illustrated, elastic plate 101 has engagement slots 102 for engaging with the engagement hooks 601. Two side faces of the board connector 6 may each be provided with a slot 60 for accommodating the projection 52. In the illustrated embodiment, two slots 60 are formed in opposing side walls of the insulating body 62 serving as a housing for board connector 6. The slots 60 are open at the top of the side walls and extend in the mating direction 13, perpendicular to the bottom of board connector 6 adapted to be mounted against a printed circuit board. In the illustrated embodiment, there are two engagement hooks 601 in each side of the board connector 6 with a slot 60 between the two engagement hooks 601.

Figure 10:
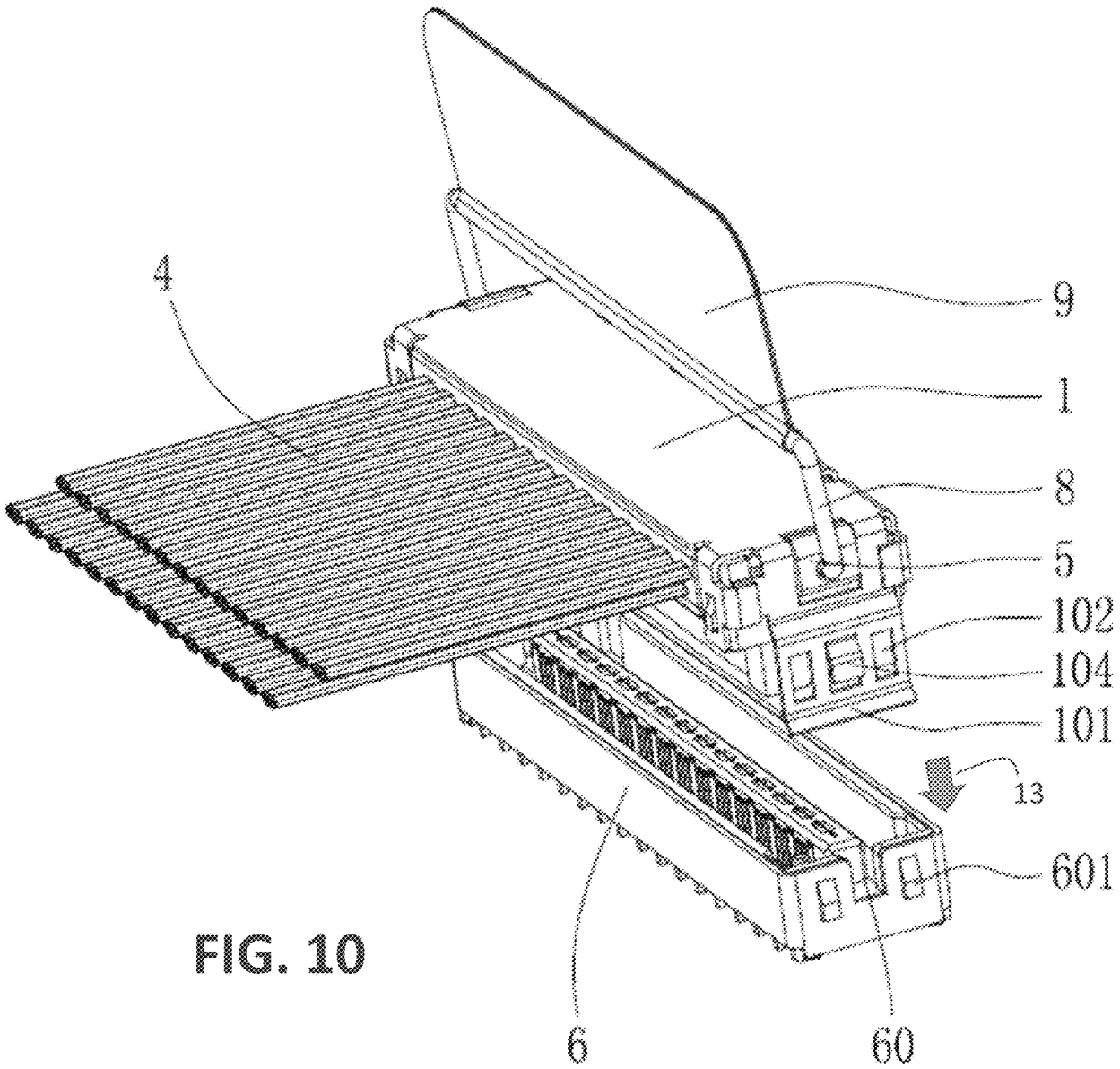
FIG. 10 is a perspective view of the cable connector of FIG. 1 and the board connector of FIG. 8 in a connector assembly when in an unlatched state.
Figure 11:
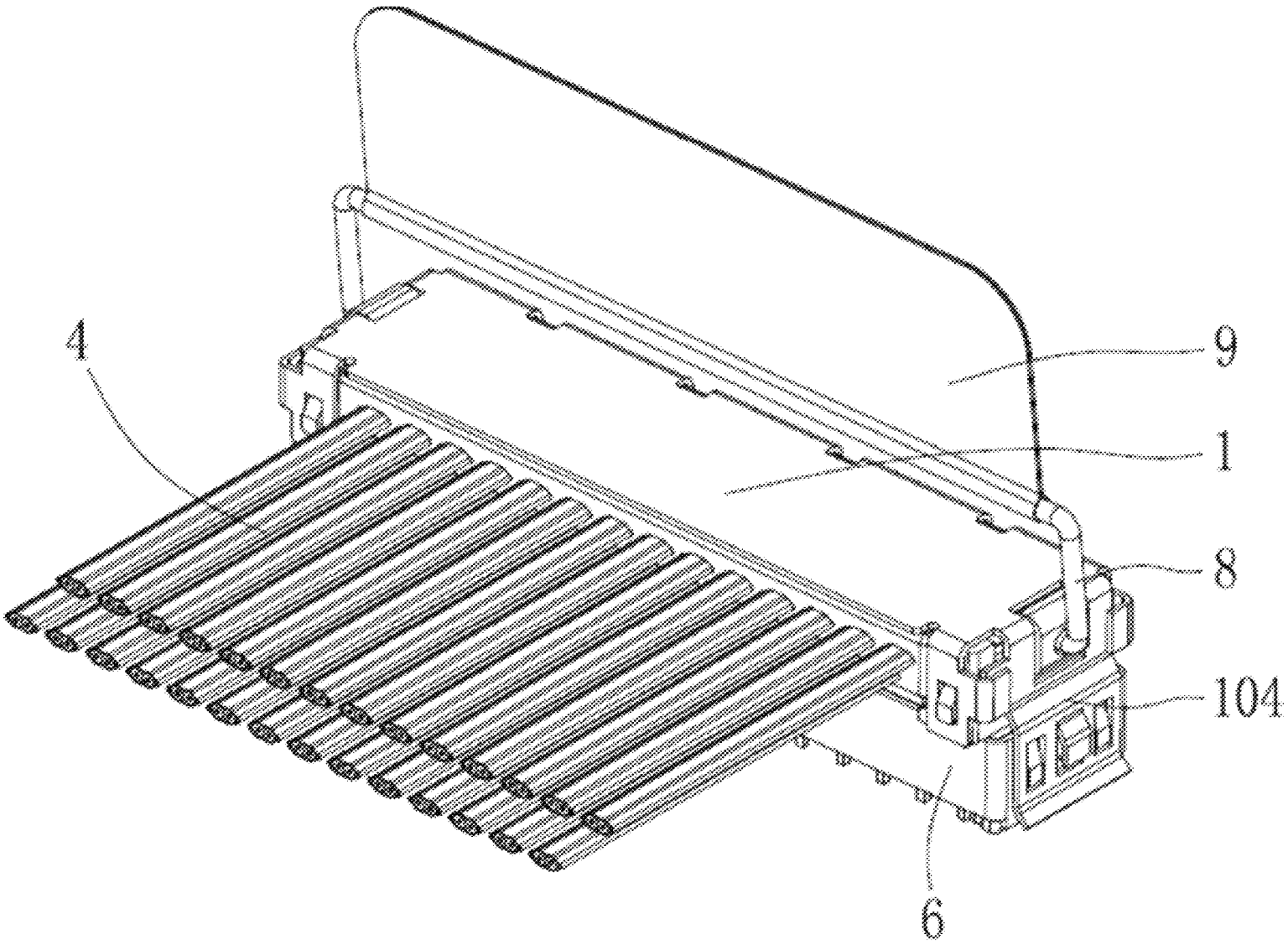
FIG. 11 is a perspective view of the cable connector and the board connector of FIG. 10 in a connector assembly when in a latched state.

As shown in FIGS. 10 and 11, a connector assembly comprises the cable connector 1 and board connector 6. Cable connector 1 may be aligned with board connector 6 and then moved in mating direction 13 such that the connectors mate. The board connector 6 may then be latched to cable connector 1 by the engagement hooks 601 being engaged in the engagement slots 102 in the elastic plate 101.

An exemplary assembly process of the connector assembly may be as follows:

Assembly of the cable connector 1: The first row of terminals 312 and the first plastic fixing member 311 may be integrally injection molded to form the first terminal module 31. The second row of terminals 322 and the second plastic fixing member 321 may be integrally injection molded to form the second terminal module 32.

The first terminal module 31 and the second terminal module 32 may each be inserted into the plastic body 2. The mating contact portions of the terminals of the terminal modules may be exposed within mating portion 22. In the embodiment illustrated, the mating contact portions of the terminals line two opposing interior walls of the mating portion 22.

Conductors of two rows of cables 4 may be electrically and mechanically attached to tails of the terminals in the first row of terminals 312 and the second row of terminals 322. Attachment may be done using a soldering process.

The inner module 7 may then be added to cover the joints between the cables and the terminals. In the illustrated embodiment, inner module 7 is injection molded in the plastic body 2 to cover all soldering points of the cables 4.

The two sliders 5 may then be mounted in the guide grooves 20 at the side edges of the plastic body 2 such that the lugs 51 at the side edges of the sliders 5 are engaged with the limiting steps 200, and a gap is left between an end of the slider 5 and top panel 100.

The shielding casing 10 may then be attached to the outside of the plastic body 2. The protrusions 201 on upper portion 21 are engaged with the holes 108 in the front wall 106. The protrusions 201 at the bottom of the two arms 211 are engaged with the holes 108 in the two rear wall portions 107 respectively.

The projections 52 at the front end of the sliders 5 are positioned in the openings 103 of the elastic plates 101. Attaching shielding casing 10 captures sliders 5 in the guide grooves 20 such that sliders 5 may slide. Additionally, tab 104 on shield casing 10 may exert a force on projection 52, which, because of the tapered shape of inclined face 53 and tab 104, is converted, via a camming action, into a force urging slider 5 towards the mating interface such that lugs 51 contact steps 200.

The two ends of the pull rod 8 may be mounted in the mounting holes 541 of the two engagement parts 54 respectively. A head end of the pull tab 9 may be fixed to a supporting crossbar of the pull rod 8.

Assembly of the board connector 6: The third plastic fixing member 631 may be injection molded around third row of terminals 632 to form the third terminal module 63. The fourth plastic fixing member 651 may be injection molded around fourth row of terminals 652 to form the fourth terminal module 65. The lossy strip 64 may be injection molded around the metal grounding plate 66.

From top to bottom, the third terminal module 63, the lossy strip 64 and the fourth terminal module 65 are mounted parallel to each other and inserted into the insulating body 62, bringing the second ground terminals 604 on the third row of terminals 632 and the fourth row of terminals 652 into contact with the lossy blocks 641 on the lossy strip 64.

The locating posts 603 may be mounted at two corner ends on a diagonal line in the insulating body 62, with the locating posts 603 having the protruding soldering parts 6031 at an end remote from the cable connector 1, and the assembled insulating body 62 is mounted in the metal shell 61.

Mating of the connectors to form a connector assembly: the mating portion 22 of the cable connector 1 is guided into engagement with the board connector 6 via the guiding action of the locating posts 603 and the locating holes 222 and the bosses 221 and the recesses 602. The connectors are aligned such that the projections 52 on the sliders 5 are inserted into the slots 60 of the board connector 6.

With no pulling force on the pulling member, a spring force generated from elastic plate 101 being separated from plastic body 2 will result in the inside face of tab 104 exerting a force on outside face of the projection 52. Because these surfaces are tapered, the force generate by elastic plate 101 will force engagement part 54 towards mating interface 12, enabling elastic plate 101 to return to its rest position, biased inwards towards plastic body 2.

As connectors 1 and 6 are pressed together, with mating portion 22 within an opening of insulating body 62, the elastic plates 101 will slide along the sides of connector 6. Because of the tapered shape of engagement hooks 601, the elastic plates 101 will be deflected away from the sides of connector 6.

When fully pressed together, cable connector 1 is butt-connected to connector 6. In this position, the engagement slots 102 in the elastic plates 101 align with engagement hooks 601 such that elastic plates 101 are no longer held away from the sides of board connector 6. In this state, elastic plates 101 spring back, inwards towards sides of board connector 6 such that engagement hooks 601 extend into engagement slots 102. The latching structures of the connectors hold the connectors in this position. The engagement hooks 601 at the side of the board connector 6 are engaged in the engagement slots 102 in the elastic plates 101 such that the connectors are latched together.

To unlatch and unmate the connectors: the pull tab 9 is pulled toward a side remote from the board connector 6, which is opposite the mating direction 13 in eh illustrated embodiments. The pull tab 9 drives the pull rod 8, and in turn drives the sliders 5 to slide in a direction opposite the mating direction 13. The projections 52 experience interference with the tabs 104 on the elastic plates 101, and in turn push the elastic plates 101 outward. When the elastic plates have been pushed a sufficient distance, the engagement hooks on the board connector 6 disengage from the engagement slots 102 in the elastic plates 101. As the pulling of the pull tab 9 continues, the mating portion 22 of the cable connector 1 is disengaged from the board connector 6.

With the described configuration, connectors 1 and 6 may be mated as a result of motion in the mating direction 13. Unlatching and unmating can both be achieved by pulling on pull tab 9 in a direction opposite the mating direction. Thus, both mating and umating of the connectors requires motion perpendicular to the surface of a printed circuit board to which board connector 6 is mounted. Clearance around the board connector is not required to access the connector assembly for unlatching, which can lead to a compact electronic system.

Figure 12:
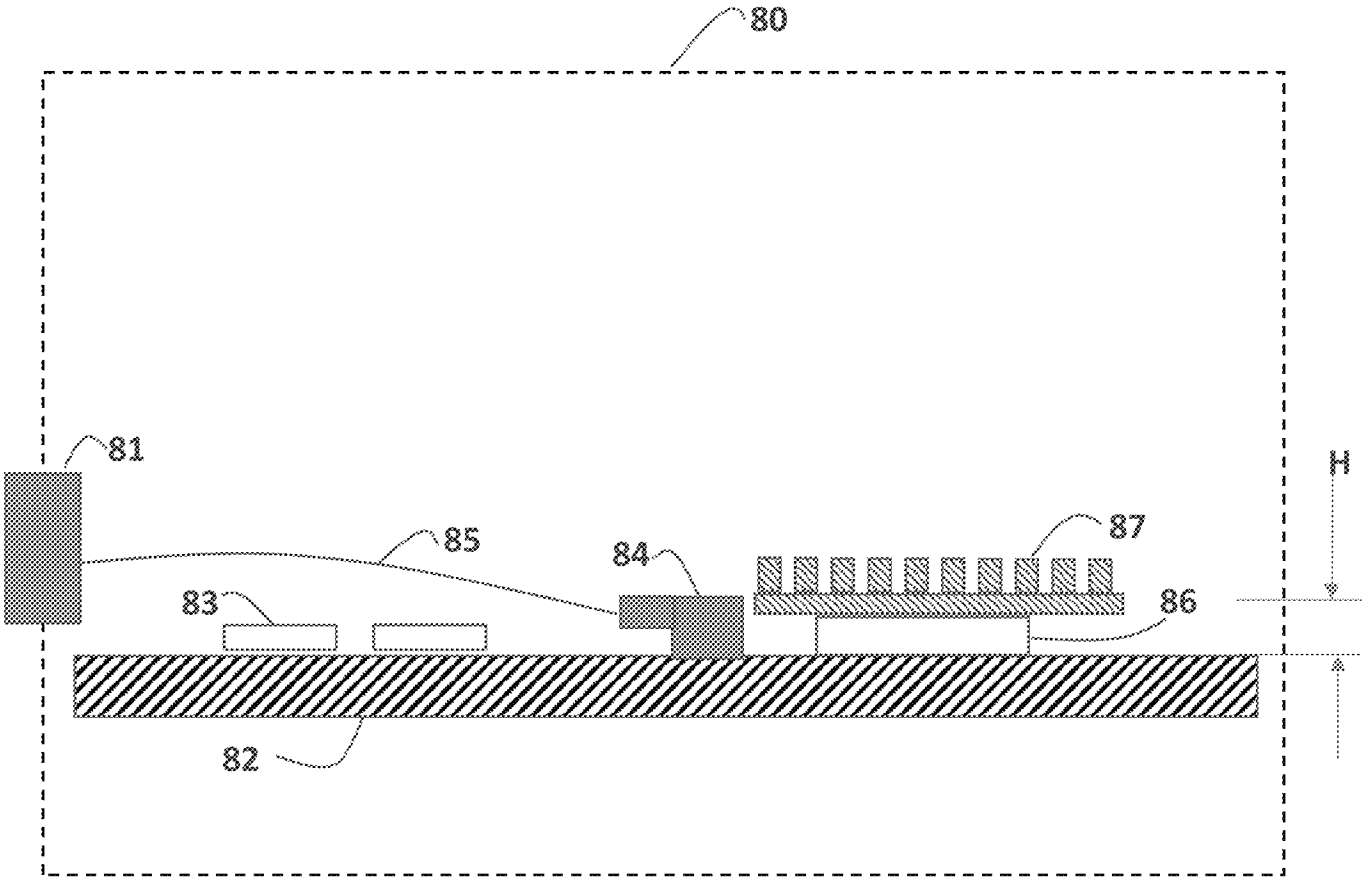
FIG. 12 is a schematic diagram of an exemplary embodiment of a compact electronic system using a connector as described herein.

FIG. 12 is a schematic illustration of an electronic device 80, which may be a server, switch or other electronic device, utilizing such a connector assembly. In the embodiment illustrated, electronic device 80 includes an electronic component, such processor 86, which processes a large number of high-speed electronic signals.

Processor 86, as well as other electronic components 83, are mounted to a printed circuit board 82. Signals may be routed to and from a processor 86 through traces in printed circuit board 82, as in conventional electronic system. Some of those signals may pass in and out of electronic device 83 through I/O connector 81. Here I/O connector 81 is shown mounted in an opening of an enclosure of electronic device 80.

For some electronic devices that process high-speed signals, the amount of signal loss that occurs in a path through printed circuit board 82 from I/O connector 81 to processor 86 may be unacceptably large. Such losses might occur, for example, in an electronic system processing 56 GHz or 112 GHz signals when the path through the printed circuit board 82 is approximately 6 inches or longer.

A low loss path may be provided through cables 85. In the electronic device illustrated in FIG. 12, cable 85 connects I/O connector 81 to a connector assembly 84 mounted to printed circuit board 82 near processor 86. The distance between connector assembly 84 and processor 86 may be of the order of 1 inch or less. Connector assembly 84 may be implemented using connectors as described herein. A board connector 2 may be mounted to printed circuit board 82 adjacent processor 86. A cable connector, such as cable connector 1, may terminate cable 85. Cable connector 1 may be plugged into board connector 2, creating connector assembly 84.

FIG. 12 illustrates that a connector assembly as described herein may fit within a small space that may have little impact on the size of electronic device 80. As shown, a heat sink 87 may be attached to the top of processor 86. A connector assembly 84 as described herein may have a height H between 5 and 12 mm, or between 8 and 10 mm in other embodiments, for example. This height may be on the order of the height of heatsink 87 or shorter.

Moreover, as the connectors of connector assembly 84 mate and unmate in a direction perpendicular to the surface of printed circuit board 82, and unmating may be achieved by a user pulling on a pull tab mounting on the top of connector assembly 84, very little space is needed around connector assembly 84 to allow access to the connectors for mating and unmating. Such a configuration may lead to a compact electronic device.

Although the present invention has been shown and presented specifically with reference to preferred embodiments, those skilled in the art will understand that various changes in form and detail made to the present invention within the spirit and scope of the present invention as defined in the attached claims are included in the scope of protection of the present invention.

Lossy strip 64 and lossy blocks 641 may be formed of materials that conduct, but with some loss, or materials that by a non-conductive physical mechanism absorbs electromagnetic energy over the frequency range of interest. Such materials are referred to herein generally as "lossy" materials. Electrically lossy materials may be formed from lossy dielectric materials and/or poorly conductive materials and/or lossy magnetic materials.

Magnetically lossy materials may include, for example, materials traditionally regarded as ferromagnetic materials, such as those that have a magnetic loss tangent greater than approximately 0.05 in the frequency range of interest. The "magnetic loss tangent" is generally known to be the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest.

Electrically lossy materials may be formed from material traditionally regarded as dielectric materials, such as those that have an electric loss tangent greater than approximately 0.05 in the frequency range of interest. The "electric loss tangent" is generally known to be the ratio of the imaginary part to the real part of the complex electrical permittivity of the material. For example, an electrically lossy material may be formed of a dielectric material in which is embedded a conductive web that results in an electric loss tangent greater than approximately 0.05 in the frequency range of interest.

Electrically lossy materials may be formed from materials that are generally thought of as conductors, but are relatively poor conductors over the frequency range of interest, or contain conductive particles or regions that are sufficiently dispersed that they do not provide high conductivity, or are prepared with properties that lead to a relatively weak bulk conductivity compared to a good conductor (e.g., copper) over the frequency range of interest.

Electrically lossy materials typically have a bulk conductivity of about 1 siemen/meter to about 100,000 siemens/meter and preferably about 1 siemen/meter to about 10,000 siemens/meter. In some embodiments, material with a bulk conductivity of between about 10 siemens/meter and about 200 siemens/meter may be used. As a specific example, material with a conductivity of about 50 siemens/meter may be used. However, it should be appreciated that the conductivity of the material may be selected empirically or through electrical simulation using known simulation tools to determine a suitable conductivity that provides both a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material may have a surface resistivity between 10 Ω/square and 1000 Ω/square. As a specific example, the electrically lossy material may have a surface resistivity of between about 20 Ω/square and 80 Ω/square.

In some embodiments, an electrically lossy material may be formed by adding to a binder a filler that contains conductive particles. In an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers, or other particles may also be used to provide suitable electrically lossy properties. Alternatively, combinations of fillers may be used. For example, metal-plated carbon particles may be used. Silver and nickel may be suitable metals for metal-plating fibers. Coated particles may be used alone or in combination with other fillers, such as carbon flakes. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used.

Also, although the binder materials discussed above may be used to create an electrically lossy material by forming a matrix around conductive particle fillers, the present technology described herein is not so limited. For example, conductive particles may be impregnated into a formed matrix material or may be coated onto a formed matrix material, such as by applying a conductive coating to a plastic component or a metal component. As used herein, the term "binder" may encompass a material that encapsulates the filler, is impregnated with the filler or otherwise serves as a substrate to hold the filler.

In some embodiments, the fillers may be present in a sufficient volume percentage to allow conducting paths to be created from particle to particle. For example, when metal fiber is used, the fiber may be present at about 3% to 40% by volume. The amount of filler may impact the conducting properties of the material.

Filled materials may be purchased commercially, such as materials sold under the trade name Celestran® by Celanese Corporation, which can be filled with carbon fibers or stainless steel filaments.

Alternatively, lossy member may be formed in other ways. In some embodiments, a lossy member may be formed by interleaving layers of lossy and conductive material such as metal foil. These layers may be rigidly attached to one another, such as through the use of epoxy or another adhesive, or may be held together in any other suitable way. The layers may be of the desired shape before being secured to one another or may be stamped or otherwise shaped after they are held together. Alternatively or additionally, a lossy material may be formed by depositing or otherwise forming a diffuse layer of conductive material, such as metal, over an insulative substrate, such as plastic, to provide a composite part with lossy characteristics, as described above.

In various example embodiments described herein, lossy components may be formed of an electrically lossy material. In some specific examples, that lossy material may have a plastic matrix, such that members may be readily molded into a desired shape. The plastic matrix may be made partially conductive by the incorporation of conductive fillers, as described above, such that the matrix becomes lossy.

The frequency range of interest may depend on the operating parameters of the system in which such the connector is used, but may generally have an upper limit between about 15 GHz and 120 GHz, such as 25, 30, 40, 56 or 112 GHz, although higher frequencies or lower frequencies may be of interest in some applications. Some connector designs may have frequency ranges of interest that span only a portion of this range, such as 1 GHz to 10 GHz, or 3 GHz to 15 GHz, or 5 GHz to 35 GHz.

Designs of an electrical connector are described herein that improve signal integrity for high-frequency signals, such as at frequencies in the GHz range, including up to about 56 GHz or up to about 120 GHz or higher, while maintaining a high density, such as with an edge to edge spacing between adjacent contacts (e.g., conductive elements) of approximately 0.25 mm or less, with a center-to-center spacing between adjacent contacts in a row of between 0.5 mm and 0.8 mm, for example. The contacts may have a width of between 0.3 mm and 0.4 mm for some types of contacts, and may have a width of between 0.65 mm and 0.75 mm for other types of contacts. As a specific example, the center-to-center spacing may be 0.6 mm for two adjacent contacts of a same type, and may be 0.75 mm for two adjacent contacts of different types.

It should be understood that various alterations, modifications, and improvements may be made to the structures, configurations, and methods discussed above, and are intended to be within the spirit and scope of the invention disclosed herein.

For example, any or all of the features described in U.S. Provisional Application No. 62/805,812, filed Feb. 14, 2019, entitled "ROBUST, HIGH-FREQUENCY ELECTRICAL CONNECTOR," to U.S. Provisional Application No. 62/802,619, filed Feb. 7, 2019, entitled "ROBUST, COMPACT ELECTRICAL CONNECTOR," and to U.S. Provisional Application No. 62/783,336, filed Dec. 21, 2018, entitled "ROBUST, MINIATURIZED CARD EDGE CONNECTOR" may be used instead of or in addition to the features of connector 6 described herein.

As an example of other variations, connectors are described with latching components disposed on opposite ends of the connectors. Where components are described on one side of the connector, it should be understood that the opposite side may have similar components. Conversely, where components are described on both sides, it should be understood that embodiments with such components on only one side of the connector are possible.

Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Further, terms denoting direction have been used, such as "left", "right", "forward" or "up". These terms are relative to the illustrated embodiments, as depicted in the drawings, for ease of understanding. It should be understood that the components as described herein may be used in any suitable orientation.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or"

should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of," "Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ±20% of a target value in some embodiments, within ±10% of a target value in some embodiments, within ±5% of a target value in some embodiments, and within ±2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

What is claimed is:

1. A cable connector configured for terminating a cable, the cable connector comprising:

a plastic body, a terminal module disposed in the plastic body, wherein the terminal module comprises a plurality of terminals each having a contact tail configured for connection to a conductor of the cable, a shielding casing covering the plastic body and comprising two sides, each of the two sides comprising an elastic plate outside the plastic body and having an engagement slot forming a portion of a latch, two sliders slidably mounted at two sides of the plastic body between the plastic body and the shielding casing, with one end of each slider of the two sliders comprising an outwardly protruding projection, and a pull rod comprising two ends, with each end of the two ends of the pull rod connected to a slider of the two sliders;

wherein:

the elastic plates are each provided with a tab having a shape adapted to the projection; and the two sliders are retained within an interior of the shielding casing.

2. The cable connector of claim 1, wherein the two sliders are retained between the plastic body and the shielding casing.

3. The cable connector of claim 2, wherein:

the plastic body comprises guide grooves, and sliders of the two sliders are retained within respective ones of the guide grooves.

4. The cable connector of claim 1, wherein:

the terminal module comprises a first terminal module;

the cable connector comprises a second terminal module arranged in parallel above the first terminal module;

the first terminal module comprises a first plastic fixing member molded around a first row of terminals;

the second terminal module comprises a second plastic fixing member molded around a second row of terminals;

the first row of terminals and the second row of terminals each comprise first ground terminals and first signal terminal pairs alternately in sequence;

the first signal terminal pairs comprise two first signal terminals which are symmetric with respect to each other, and the first row of terminals and the second row of terminals are staggered with respect to each other.

5. The cable connector as claimed in claim 4, wherein a distance between a terminal of the first ground terminals and a terminal of the first signal terminal pairs is greater than a distance between two terminals of the first signal terminal pairs.

6. The cable connector of claim 1, wherein:

the plastic body comprises an upper portion and a mating portion;

two sides of a bottom of the upper portion are each provided with an insert-connection arm, and protrusions are respectively provided at a top of the upper portion and a bottom of the insert-connection arms;

a top of the shielding casing is bent inward to form a front wall and rear wall portions;

holes for engaging with the protrusions are respectively provided in the front wall and rear wall portions.

7. The cable connector of claim 6, wherein two sides of the front wall and outer sides of the rear wall portions are respectively bent toward the elastic plates to form extension arms for limiting a position of the elastic plates.

8. A connector assembly, comprising a cable connector and a board connector, wherein:

the cable connector is the cable connector as claimed in claim 1, and two sides of the board connector are each provided with an engagement hook;

the shielding casing is latched via connection of the engagement slots with the engagement hooks, and the pull rod is configured to drive the two sliders to move in a direction away from the board connector such that the projections push open interference parts of the cable connector to disengage the engagement hooks from the engagement slots.

9. The connector assembly as claimed in claim 8, wherein:

the board connector comprises a metal shell, an insulating body fixed inside the metal shell, and a terminal assembly mounted in the insulating body;

the terminal assembly comprises a third terminal module, a lossy strip and a fourth terminal module, arranged parallel to each other in sequence from top to bottom;

a metal grounding plate is integrated with a front end of the lossy strip;

the third terminal module comprises a third row of terminals held by a third plastic fixing member molded around the terminals of the third row;

the fourth terminal module comprises a fourth row of terminals held by a fourth plastic fixing member molded around the terminals in the fourth row;

the third row of terminals and the fourth row of terminals each comprise second ground terminals and second signal terminal pairs alternately in sequence;

the second ground terminals are connected to the lossy strip via lossy blocks, and the third row of terminals and the fourth row of terminals are arranged in a staggered manner.

10. The connector assembly as claimed in claim 8, wherein two side faces of the board connector each comprise a slot accommodating the projection.

11. The connector assembly as claimed in claim 8, wherein:

the plastic body comprises two locating holes on a side close to the board connector; and the two locating holes are arranged diagonally, and two locating posts for fitting the locating holes are fixed in corresponding positions inside the board connector.

12. The connector assembly as claimed in claim 8, wherein:

bosses are provided at an exterior of three corners of the plastic body on a side close to the board connector, and the board connector is provided with three recesses for engaging with the bosses.

13. The cable connector as claimed in claim 1, wherein:

the outwardly protruding projection comprises an outside face with an inclined face or arcuate face, the elastic plate comprises an opening with a rear-end edge of the opening bent outward to form the tab, and an inside face of the tab and the outside face of the projection have a same shape.

14. The cable connector of claim 1, wherein two side faces of the plastic body each comprise a guide groove;

the slider is movably mounted in the guide groove;

two sides of the slider are each provided with a lug; and a side of the guide groove comprises a step for limiting a position of the lug.

15. A cable connector configured for terminating a cable, the cable connector comprising:

a plastic body;

a terminal module disposed in the plastic body, wherein the terminal module comprises a plurality of terminals each having a contact tail configured for connection to a conductor of the cable;

a shielding casing covering the plastic body and comprising two sides, each of the two sides comprising an elastic plate outside the plastic body and having an engagement slot;

two sliders movably mounted at two sides of the plastic body, with one end of each slider of the two sliders comprising an outwardly protruding projection; and a pull rod comprising two ends, with each end of the two ends of the pull rod connected to a slider of the two sliders, wherein:

the elastic plates are each provided with a tab having a shape adapted to the projection;

the two sliders are retained within an interior of the shielding casing;

a rear end of each of the two sliders comprises an engagement part;

the elastic plates each comprise an accommodating hole for accommodating the engagement part;

the engagement part of each of the two sliders comprises a mounting hole;

two ends of the pull rod are respectively fixed in the mounting holes of the engagement parts; and a pull tab is attached to the pull rod.

16. A cable connector configured for terminating a cable, the cable connector comprising:

a plastic body;

a terminal module disposed in the plastic body, wherein the terminal module comprises a plurality of terminals each having a contact tail configured for connection to a conductor of the cable;

a shielding casing covering the plastic body and comprising two sides, each of the two sides comprising an elastic plate outside the plastic body and having an engagement slot;

two sliders movably mounted at two sides of the plastic body, with one end of each slider of the two sliders comprising an outwardly protruding projection; and a pull rod comprising two ends, with each end of the two ends of the pull rod connected to a slider of the two sliders, wherein:

the elastic plates are each provided with a tab having a shape adapted to the projection;

the two sliders are retained within an interior of the shielding casing;

the terminal module comprises a first terminal module;

the first terminal module comprises a first plastic fixing member molded around a first row of terminals;

the first row of terminals comprises first ground terminals and first signal terminal pairs alternately in sequence; and a width of a terminal of the first ground terminals is greater than a width of a terminal of the first signal terminal pairs.

17. A cable connector configured for terminating a cable, the cable connector comprising:

a plastic body;

a terminal module disposed in the plastic body, wherein the terminal module comprises a plurality of terminals each having a contact tail configured for connection to a conductor of the cable;

a shielding casing covering the plastic body and comprising two sides, each of the two sides comprising an elastic plate outside the plastic body and having an engagement slot;

two sliders movably mounted at two sides of the plastic body, with one end of each slider of the two sliders comprising an outwardly protruding projection; and a pull rod comprising two ends, with each end of the two ends of the pull rod connected to a slider of the two sliders, wherein:

the elastic plates are each provided with a tab having a shape adapted to the projection;

the two sliders are retained within an interior of the shielding casing; and an inner module for covering soldering points between the cable and the terminal module is provided inside the cable connector.

18. A method of operating a connector assembly comprising a cable connector and a board connector, the method comprising:

S1: during mating of the connectors:

aligning bosses on a plastic body of the cable connector with recesses of an insulating body of the board connector, inserting locating posts on the insulating body into locating holes of the plastic body, and moving the cable connector and the board connector together in a mating direction such that engagement slots at two sides of a shielding casing of the cable connector are engaged with engagement hooks at sides of the board connector, to latch the cable connector and the board connector in the connector assembly;

S2: during unmating of the connectors:

pulling a pull tab or pull rod in a direction opposite the mating direction so as to drive sliders to slide away from the board connector, such that projections of the sliders experience interference with tabs disposed on elastic plates of the shielding casing and push the elastic plates outward, so as to disengage the engagement hooks on the board connector from the engagement slots in the elastic plates; and continuing to pull on the pull tab or pull rod such that the cable connector is disengaged from the board connector.

19. An electronic system, comprising:

a printed circuit board comprising a surface;

a high speed electronic component mounted to the surface of the printed circuit board;

a board connector mounted adjacent to the high speed electronic component, wherein the board connector comprises opposite sides and engagement hooks extending from the sides;

a cable connector mated with the board connector, wherein the cable connector comprises:

an insulative body;

a shielding casing at least partially surrounding the insulative body and having elastic plates spring biased inwards towards the sides of the board connector, wherein the elastic plates have openings configured to receive the engagement hooks when the cable connector is mated to the board connector;

slidable members, slidably mounted between the insulative body and shielding casing such that the slidable members slide, in a direction perpendicular to the surface of the printed circuit board and opposite a mating direction, between a latched position and an unlatched position, wherein the slidable members comprise inclined faces configured to interfere with the elastic plates when in the unlatched position so as to press the elastic plates outwards; and a pull tab coupled to the slidable members and accessible from a top of the cable connector such that pulling on the pull tab in a direction opposite the mating direction unlatches and unmates the connectors.

20. The electronic system of claim 19, wherein:

the system further comprises a heat sink mounted attached to a processor mounted to the surface of the printed circuit board; and the mated cable connector and board connector have a height less than or equal to a height of the heat sink.

21. The electronic system of claim 19, further comprising:

an I/O connector; and a cable coupling the cable connector to the I/O connector.

22. The electronic system of claim 19, wherein:

the shielding casing has openings exposing portions of the slidable members;

the cable connector further comprises a rod coupled to the portions of the slidable members exposed in the openings; and the pull tab is connected to the rod.

23. The electronic system of claim 19, wherein the board connector comprises:

an insulative body comprising opposite sides; and a metal shell at least partially surrounding the insulative body, wherein the metal shell comprises at least one engagement hook of the engagement hooks disposed adjacent each of the opposite sides, wherein the at least one engagement hook extends outwardly from the insulative body so as to engage the openings of the shielding casing of the cable connector.

24. The electronic system of claim 23, wherein:

each of the opposite sides comprises a slot configured to accommodate a projection from the cable connector.

25. The electronic system of claim 24, wherein:

the slot of each of the opposite sides extend in a mating direction from tops of the opposite sides.

26. The electronic system of claim 24, wherein:

the at least one engagement hook comprises two engagement hooks; and the slot of each of the opposite sides are between two engagement hooks.

* * * * *